US007225578B2

(12) United States Patent
Tai

(10) Patent No.: US 7,225,578 B2
(45) Date of Patent: Jun. 5, 2007

(54) AIMING SIGHT HAVING FIXED LIGHT EMITTING DIODE (LED) ARRAY AND ROTATABLE COLLIMATOR

(75) Inventor: Anthony M. Tai, Northville, MI (US)

(73) Assignee: EOTech Acquisition Corp., Ann Arbor, MI (US)

( * ) Notice: Subject to any disclaimer, the term of this patent is extended or adjusted under 35 U.S.C. 154(b) by 252 days.

(21) Appl. No.: 11/030,742

(22) Filed: Jan. 6, 2005

(65) Prior Publication Data

US 2006/0162226 A1 Jul. 27, 2006

(51) Int. Cl.
*F41G 1/473* (2006.01)
*F41G 1/48* (2006.01)

(52) U.S. Cl. ..... 42/132; 42/111; 33/334

(58) Field of Classification Search ..... 42/102, 42/111–115, 117, 132; 359/15; 33/333, 33/334

See application file for complete search history.

(56) References Cited

U.S. PATENT DOCUMENTS 3,905,708 A 9/1975 Steck, III
4,346,995 A * 8/1982 Morris ..... 356/251
5,189,555 A * 2/1993 Jorlov ..... 359/618
5,483,362 A 1/1996 Tai et al.
5,815,936 A 10/1998 Sieczka et al.
5,824,942 A * 10/1998 Mladjan et al. ..... 89/41.17
5,901,452 A * 5/1999 Clarkson ..... 42/131
6,111,692 A * 8/2000 Sauter ..... 359/429
6,490,060 B1 12/2002 Tai et al.
6,807,742 B2 * 10/2004 Schick et al. ..... 33/297
7,145,703 B2 * 12/2006 Sieczka et al. ..... 359/15
2005/0039370 A1 * 2/2005 Strong ..... 42/130
2006/0010760 A1 * 1/2006 Perkins et al. ..... 42/142

* cited by examiner

*Primary Examiner*—Troy Chambers
*Assistant Examiner*—Stewart T. Knox
(74) *Attorney, Agent, or Firm*—Brooks Kushman, P.C.

(57) ABSTRACT

An aiming sight includes a controller, a power supply, an LED array, and a collimator. The power supply powers the LEDs to turn-on and turn-off, and powers the collimator to rotate. The collimator rotates to different rotational positions while the controller, the power supply, and the LED array remain fixed in place. The LEDs are positioned such that one LED and the collimator are at a constant angle and separated by a constant focal distance for each collimator position. The controller controls the collimator to rotate to a collimator position to generate an aiming dot at an angular position corresponding to the collimator position. The controller turns-on the LED which is at the constant angle and separated from the collimator by the constant focal distance and turns-off the remaining LEDs such that the collimator collimates light from the turned-on LED into the aiming dot at the angular position corresponding to the collimator position.

16 Claims, 4 Drawing Sheets

AIMING SIGHT HAVING FIXED LIGHT EMITTING DIODE (LED) ARRAY AND ROTATABLE COLLIMATOR

BACKGROUND OF THE INVENTION

1. Field of the Invention

The present invention generally relates to aiming sights for use with firearms and, more particularly, to an aiming sight having a fixed light emitting diode (LED) array and a rotatable collimator which function together to change angular position of an aiming dot such that the aiming dot has parallax-free performance over a relatively large elevation angle adjustment range.

2. Background Art

Certain firearms launch relatively low-velocity projectiles such as grenades, air burst ammunition, and non-lethal rubber bullets. Low-velocity projectile firearms require aiming sights having a wide elevation angle adjustment range because the amount of projectile drop increases significantly with distance from the firearms to targets. Traditionally, aiming sights used with such firearms have been leaf sights. A leaf sight is an iron sight with a tall front sight. Leaf sights are limited to providing coarse aiming.

Low-velocity projectile firearms are becoming more accurate and consistent. Compact laser range finders are now available to provide precise data on target range. As such, a complete and precise fire control system for a firearm is required to take advantage of firearm accurateness and the available precise target range data.

A fire control system for a firearm generally includes a laser range finder (with a tilt sensor), a ballistic computer, and an aiming sight. The laser range finder with its tilt sensor determines the effective target range. The effective target range takes into account the elevation or depression angle of the target relative to the weapon. The ballistic computer uses the computed effective target range to determine the proper elevation angle for the firearm to engage the target. The aim point of the sight is then moved down by the same angle. By putting the aim point on the target, the firearm is tilted up to the proper elevation angle. The elevation angle adjustment of the aiming dot has to be accomplished quickly so that the target can be engaged soon after the target range has been determined.

For weapons that launch low-velocity projectiles, the elevation angle adjustment range required of the aiming sight may be as large as 30°. The field of view of an aiming sight having a magnified scope is relatively very small. As such, to cover the elevation angle adjustment range the entire magnified aiming sight is usually rotated in order to aim the aiming dot at the target.

The field of view of an aiming sight having a 1× magnification such as a reflex or red-dot sight is larger. However, the collimator optics of a 1× sight maintains proper collimation and hence parallax-free performance of an aiming dot only over a small angular range (typically within 1°). Outside of this small angular range, off-axis aberration of the reflective collimator will introduce significant parallax aiming error. As such, once again, to cover the elevation angle adjustment range the entire 1× aiming sight has to be rotated in order to aim the aiming dot at the target.

Rotating an aiming sight in its entirety is typically done mechanically using a small motor. The rotation of an entire aiming sight is relatively slow because of the amount of mass to be rotated which could include control electronics and batteries. Moreover, an exposed external aiming sight rotation mechanism is prone to jamming by dust and mud and is prone to environmental conditions such as salt fog.

SUMMARY OF THE INVENTION

Accordingly, it is an object of the present invention to provide an aiming sight having a collimator which is movable relative to a fixed light emitting diode (LED) array.

It is another object of the present invention to provide an aiming sight configured such that a collimator is the only component of the aiming sight which moves in order to adjust angular position of an aiming dot (or reticle) of the aiming sight over a relatively large elevation angle adjustment range in a parallax-free manner.

It is still another object of the present invention to provide an aiming sight having a fixed LED array and a rotatable collimator which function together to change angular position of an aiming dot of the aiming sight such that the aiming sight has parallax-free performance over a relatively large elevation angle adjustment range of the aiming dot.

It is still a further object of the present invention to provide an aiming sight having a fixed LED array and a rotatable collimator in which one of the LEDs is turned-on depending upon the rotational position of the collimator relative to the LED array in order to transmit light to the collimator for the collimator to collimate into a parallax-free aiming dot having a given angular position.

It is still yet another object of the present invention to provide an aiming sight having a fixed LED array and a rotatable collimator in which the LEDs are selectively turned-on one at a time as the rotational position of the collimator changes relative to the LED array for the collimator to use the light from the LEDs to generate a parallax-free aiming dot over a relatively large elevation angle adjustment range.

It is still yet a further object of the present invention to provide an integrated aiming sight which includes low-velocity firearm and holographic aiming sights in which the low-velocity firearm aiming sight has a collimator which is movable relative to a fixed LED array in order to provide an aiming dot for pointing a low-velocity firearm at a target and in which the holographic aiming sight provides a reticle for pointing a higher-velocity firearm such as a rifle at a target.

It is still yet another object of the present invention to provide a fire control system for a weapon in which the fire control system includes an aiming sight having a collimator which is movable relative to a fixed LED array in order to provide an aiming dot over a relatively large elevation angle adjustment range in a parallax-free manner.

In carrying out the above objects and other objects, the present invention provides an aiming sight having an LED array and a collimator. The LED array is fixed in position and the collimator is rotatable to rotate to different angular positions with respect to the LED array. An LED of the LED array turns-on as a function of the angular position of the collimator while the remaining LEDs of the LED array are turned-off such that the collimator collimates light from the turned-on LED into an aiming dot having a given angular position. The LEDs are positioned along the LED array such that one LED and the collimator are at a constant angle and separated by a constant focal distance for each angular position of the collimator. This is achieved by placing an optical field flattener in front of the linear LED array.

The LED which is at the constant angle and separated from the collimator by the constant focal distance for a corresponding angular position of the collimator turns-on while the remaining LEDs are turned-off when the collimator rotates to the corresponding angular position in order to adjust the angular position of the aiming dot.

For each angular position of the collimator, the LED which is at the constant angle and separated from the collimator by the constant focal distance turns-on while the remaining LEDs are turned-off such that the collimator collimates light from the turned-on LED into the aiming dot at a different angular position for each angular position of the collimator. The collimator and corresponding LEDs are separated by the constant focal distance for each angular position of the collimator with the use of a field flattener to cause the aiming dot at each angular position of the collimator to be parallax-free.

The LED which is at the constant angle and separated by the constant focal distance from the collimator when the collimator rotates to another angular position turns-on while the remaining LEDs turn-off such that the collimator collimates light from the turned-on LED into an aiming dot having a different angular position which corresponds to the angular position of the collimator.

The LED array may be a linear LED array upon which the LEDs are positioned at respective linear positions along the linear LED array. The linear LED array includes a field flattening lens such that the collimator and a corresponding LED are effectively at the constant angle and separated by the constant focal distance for each angular position of the collimator.

The aiming sight may further include sparsely spaced alpha-numeric displays placed besides the linear LED array. The spacing of the alpha-numeric displays corresponds to the field of view of the sight. Each alpha-numeric display is placed near a corresponding LED within the field of view of the sight associated with a target range. The alpha-numeric display which corresponds to the turned-on LED displays the measured target range. The user can see the aiming dot and the numerical display showing the measured target range.

In carrying out the above objects and other objects, the present invention provides an aiming sight for low-velocity projectile launchers such as a grenade launcher. This aiming sight includes control electronics ("a controller"), a power supply, an LED array, a rotator, a rotary encoder, and a collimator. The LED array has LEDs that can be individually turned-on and turned-off by the controller. The rotator, such as a stepping motor, is driven by the controller to rotate the collimator. The collimator rotates to different rotational positions with respect to the LED array while the controller, the power supply, and the LED array remain fixed in place. The LEDs are positioned along the LED array such that one LED and the collimator are at a constant angle and separated by a constant focal distance for each rotational position of the collimator. The controller controls the collimator to rotate to a rotational position in order to generate an aiming dot having an angular position corresponding to the rotational position of the collimator. The controller controls the LED array to turn-on the LED which is at the constant angle and separated from the collimator by the constant focal distance and to turn-off the remaining LEDs such that the collimator collimates light from the turned-on LED into the aiming dot at the angular position corresponding to the rotational position of the collimator.

Further, in carrying out the above objects and other objects, the present invention also provides another aiming sight for a high-velocity weapon such as a rifle on which the low-velocity projectile launcher is mounted into an integrated aiming sight assembly. The integrated aiming sight assembly includes a first aiming sight and a holographic aiming sight which are both contained within a housing. The first aiming sight includes an LED array which is fixed in position, and a collimator which is movable to different angular positions with respect to the LED array. An LED of the LED array turns-on as a function of the angular position of the collimator while the remaining LEDs of the LED array are turned-off such that the collimator collimates light from the turned-on LED into an aiming dot having a given angular position for an operator to see when looking through the housing. The holographic aiming sight (such as described in U.S. Pat. No. 6,490,060) provides a fixed reticle corresponding to the point of impact of the rifle for the operator to see and aim the rifle when looking through the housing. The aiming dot of the first aiming sight and the reticle of the holographic sight are provided for at the same time so that the operator can switch instantly between aiming the low-velocity projectile launcher and the rifle.

Further, in carrying out the above objects and other objects, the present invention provides a firearm having a rifle, a low-velocity projectile launcher such as a grenade launcher attached to the rifle, and an integrated aiming sight assembly attached to the rifle. The integrated aiming sight assembly includes first and holographic aiming sights contained within a housing. The first aiming sight has an LED array fixed in position, and a collimator which is movable to different angular positions with respect to the LED array. An LED of the LED array turns-on as a function of the angular position of the collimator while the remaining LEDs of the LED array are turned-off such that the collimator collimates light from the turned-on LED into an aiming dot having a given angular position for an operator to see in order to point the grenade launcher. The holographic aiming sight provides a fixed reticle corresponding to the point of impact of the rifle for the operator to see in order to aim the rifle while the first aiming sight provides the aiming dot for the grenade launcher.

Also, in carrying out the above objects and other objects, the present invention provides a fire control system for a firearm. The system includes an aiming sight having an LED array and a collimator. The collimator is rotatable to rotate to different angular positions with respect to the LED array. LEDs of the LED array are positioned such that one LED and the collimator are at a constant angle and separated by a constant focal distance for each angular position of the collimator. In each angular position of the collimator, the one LED which is at the constant angle and separated by the constant focal distance from the collimator and the collimator are together operable when the one LED is turned-on for the collimator to generate the aiming point at an elevation angle corresponding to the angular position of the collimator.

The system further includes a laser range finder to determine a target range to a target relative to the firearm, and an inclinometer to determine a target angle to the target relative to the firearm. The system further includes a ballistic computer to determine an elevation angle of an aiming point based on the target range and the target angle for the firearm to engage the target. The ballistic computer determines the elevation angle to compensate for projectile drop of the firearm based on the target range. The system also includes a controller to rotate the collimator to an angular position corresponding to the elevation angle and to turn-on the LED of the LED array which is at the constant angle and separated by the constant focal distance from the collimator in order for the collimator to generate the aiming point at the elevation angle.

DETAILED DESCRIPTION OF THE PREFERRED EMBODIMENT(S)

Figure 1:
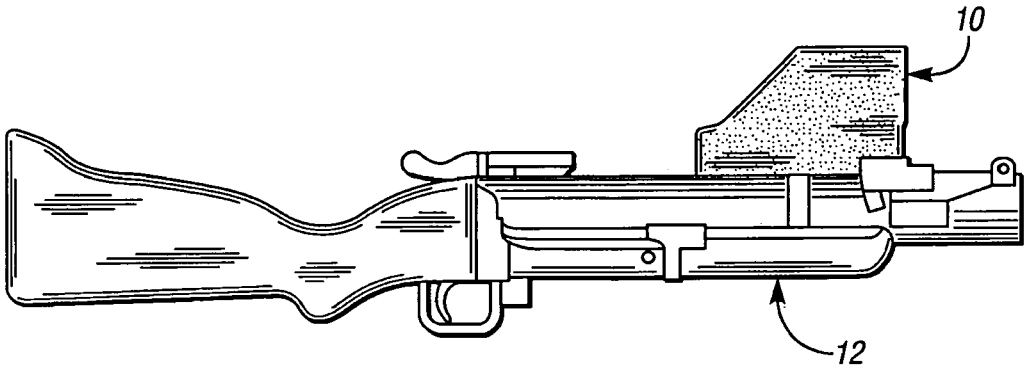
FIG. 1 illustrates a plan perspective view of an aiming sight in accordance with the present invention mounted on a firearm.

Referring now to FIG. 1, an aiming sight 10 in accordance with an embodiment of the present invention mounted on a firearm 12 is shown. Firearm 12 is intended to depict a low-velocity projectile firearm such as a shoulder-fired grenade launcher. It is to be appreciated that aiming sight 10 may be similarly mounted for use on other firearms, including, for example, firearms which launch air burst ammunition and rubber bullets.

Figure 2:
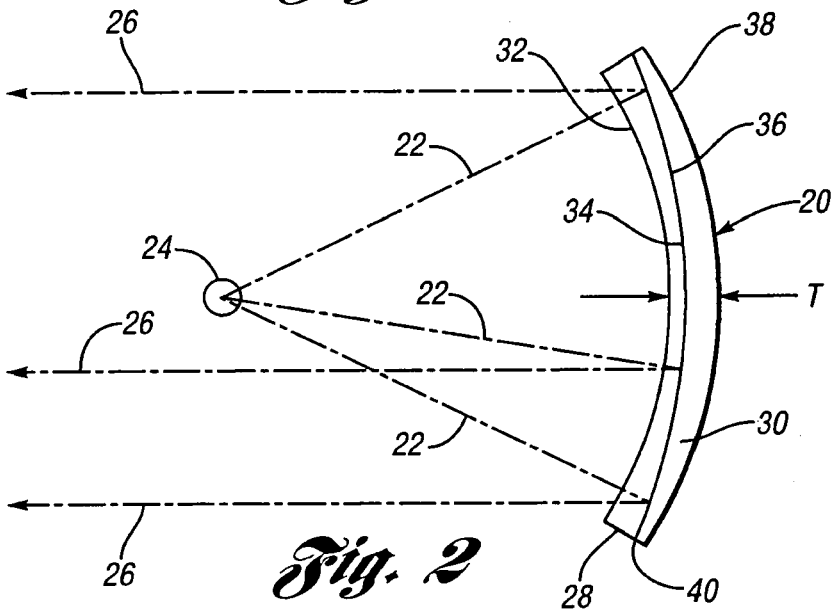
FIG. 2 illustrates a cross-sectional view of a collimator of the aiming sight in accordance with the present invention.

Referring now to FIG. 2, a side view of a reflective collimator 20 of aiming sight 10 in accordance with an embodiment of the present invention is shown. Similar to a reflex or red-dot sight such as described in U.S. Pat. No. 3,905,708, collimator 20 collimates light beams 22 emanating from a light source such as a light emitting diode (LED) 24. Collimator 20 reflects light beams 22 to collimate them as collimated light beams 26.

In accordance with an embodiment of the present invention, collimator 20 includes front and rear spherical surface glass elements 28, 30. Front glass element 28 has front and rear spherical surfaces 32, 34; and rear glass element 30 has front and rear spherical surfaces 36, 38. Front and rear glass elements 28, 30 are bonded together along their respective rear and front surfaces 34, 36 to form collimator 20. The bonded rear and front surfaces 34, 36 form a middle surface 40.

Front surface 32 of front glass element 28 has a surface radius R1. Rear surface 34 of front glass element 28 and front surface 36 of rear glass element 30 (which together make up middle surface 40) have a different surface radius R2. Rear surface 38 of rear glass element 30 has a surface radius of R1+T, where T is the overall thickness of collimator 20. The surface radii R1, R2 of spherical surfaces 32 and 34 are designed to minimize spherical aberration as taught in U.S. Pat. No. 6,490,060.

Front surface 32 of front glass element 28 and rear surface 38 of rear glass element 30 are both coated with an anti-reflection coating to minimize reflection loss. Bonded together the front and rear glass elements 28 and 30, the resulting collimator 20 has uniform glass thickness and therefore no optical power. Either rear surface 34 of front glass element 28 or front surface 36 of rear glass element 30 is coated with a spectral reflection coating that reflects the wavelength of light emitted by LED 24. As such, middle surface 40 is coated with the spectral reflection coating. The spectral reflection coating on middle surface 40 is a narrow band reflective coating that reflects the wavelength of light emitted by LED 24 and transmits all other visible wavelengths of light.

In operation, light beams 22 from LED 24 pass through front surface 32 of front glass element 28 and reach middle surface 40. The reflective coating of middle surface 40 reflects light beams 22 from LED 24 to form collimated light beams 26. Collimated light beams 26 reflect from middle surface 40 back through front surface 32 of front glass element 28 as shown in FIG. 2.

Light beams having a wavelength different from the wavelength of LED 24 pass through collimator 20 from either direction without being reflected. That is, when rear glass element 30 is bonded to front glass element 28 as shown in FIG. 2, the resulting collimator 20 has no optical power in transmission.

Figure 3:
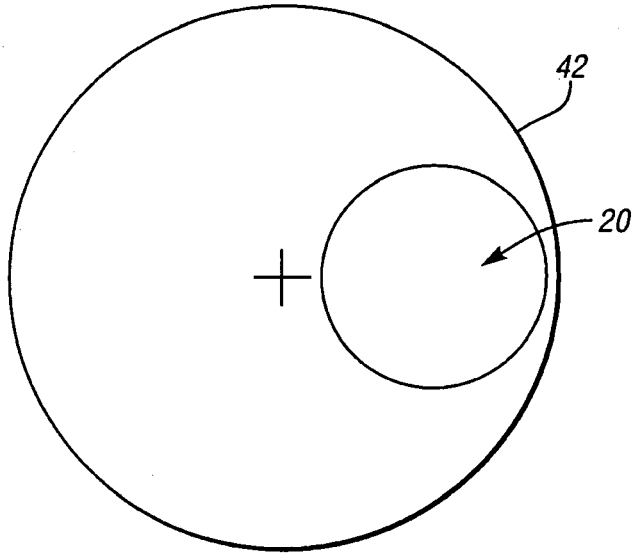
FIG. 3 illustrates a front view of a circular collimator having a cut-out portion which is used to form a collimator of the aiming sight for off-axis operation.

As shown in FIG. 2, collimator 20 and LED 24 are positioned with respect to one another to operate in an on-axis configuration. This is understood as LED 24 is positioned within the path of collimated light beams 26. To operate off-axis, collimator 20 is cut out from the side of a larger circular collimator 42 as shown in FIG. 3.

Figure 4:
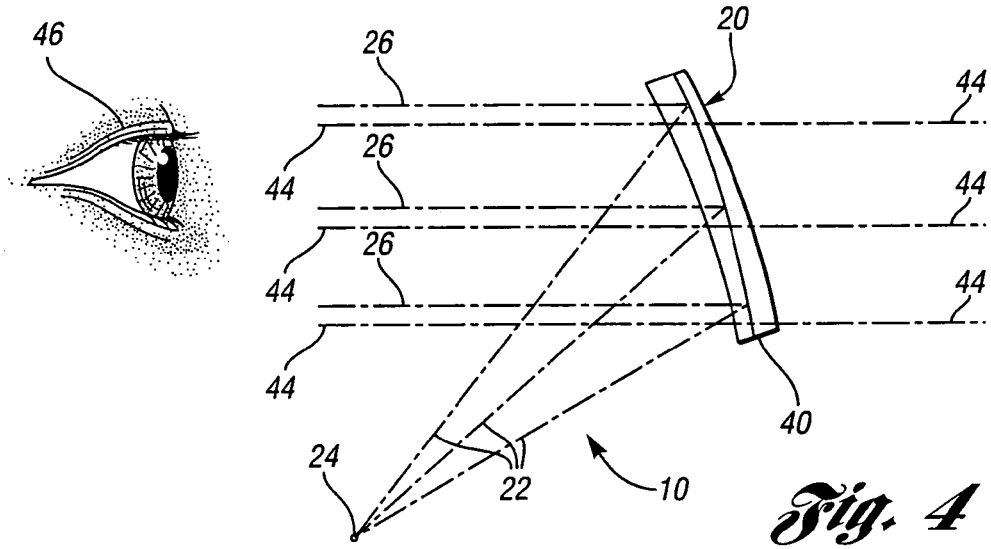
FIG. 4 illustrates a cross-sectional view of the collimator of the aiming sight operating in an off-axis configuration.

Referring now to FIG. 4, collimator 20 operating in an off-axis configuration is shown. Collimator 20 operates off-axis as LED 24 and the collimator are positioned with respect to one another such that collimated light beams 26 reflect back from the collimator at an offset angle with respect to the LED as shown in FIG. 4. Again, collimated light beams 26 reflect back from the spectral reflection coating on middle surface 40 of collimator 20. This is because the spectral reflection coating on middle surface 40 reflects a narrow spectral band of light matching that of LED light beams 22 to form collimated light beams 26. Any other light 44 which has wavelengths different from LED 24 passes through collimator 20 with little attenuation. Because collimator 20 has uniform thickness, the see-through image has little distortion.

Accordingly, as shown in FIG. 4, collimator 20 allows most light to pass through with little distortion and attenuation while it collimates light 22 from LED 24. As a result, an operator 46 looking through collimator 20 sees a target scene with minimum distortion and attenuation. Collimator 20 produces well collimated light beams 26 when LED 24 is at a proper design location (i.e., at a proper focal distance) with respect to the collimator. As a result, operator 46 looking through collimator 20 will see an aiming dot at infinity. The point of aim is independent of where within an aperture of aiming sight 10 that operator 46 is looking through collimator 20 (i.e., parallax-free aiming). This is understood as collimated light beams 26 are parallel to one another and, as such, collimator 20 provides parallax-free optical performance because LED 24 and the collimator are properly positioned with respect to one another (i.e., separated by the proper focal distance and angle) in the configuration shown in FIG. 4. That is, parallax-free aiming of the aiming dot for operator 46 is obtained when LED 24 is positioned at a proper focal point relative to collimator 20 when the collimator is operating off-axis.

However, if either collimator 20 or LED 24 is moved with respect to one another to change the angular position of the aiming dot, then off-axis aberration will degrade the parallax-free performance of aiming sight 10. That is, if either collimator 20 is rotated or if LED 24 is translated without a corresponding movement of the other one of the LED or the collimator, then off-axis aberration occurs and degrades the parallax-free performance of the aiming dot of aiming sight 10.

In the design of a conventional reflex or red-dot aiming sight, the collimator and the LED are mounted rigidly relative to one another and they are rotated together to change the angle of the aiming dot. In these conventional aiming sights, rotating the collimator and the LED together entails rotating the entire aiming sight assembly. Rotating an entire aiming sight assembly to rotate both the collimator and the LED is a viable approach for a gun sight because the range of angular adjustment required is quite small, typically within a degree. This relatively small elevation angle adjustment range is needed only to accommodate for the differences between weapons and mounting rails and to compensate for windage and bullet drops of a high-velocity bullet.

However, rotating an entire aiming sight assembly over an angular range required for low-velocity weapons such as a grenade launcher is problematic. This is because the entire mass of a typical rigid aiming sight assembly (usually housed within a tube) includes a collimator, an LED, control electronics (i.e., a controller), and batteries which have to be rotated. It simply takes too much time and effort to rotate an entire aiming sight assembly over an elevation angle adjustment range that can be as large as 30°.

A potential solution to this problem is to rotate only the LED and the collimator to reduce the aiming sight mass that has to be rotated. For this potential solution, a means such as electrical wiring is required to maintain electrical contact between the movable LED and collimator with the stationary power supplies and control electronics. A problem with this potential solution is that electrical wiring that is not secured tightly is a primary cause of failure in electronic aiming sights such as reflex and red-dot aiming sights. The repeated vibration of the electrical wiring under recoil can cause it to break due to fatigue.

Figure 5:
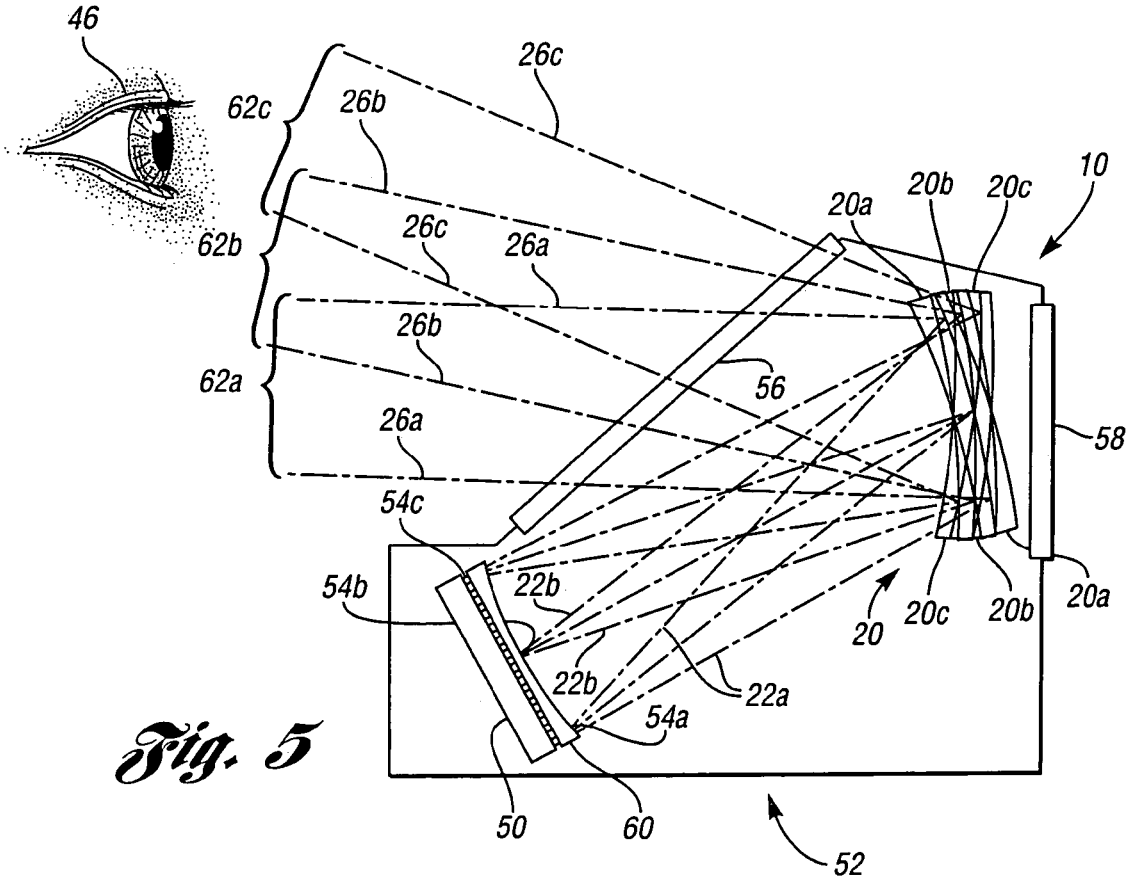
FIG. 5 illustrates a cross-sectional view of the aiming sight.

Referring now to FIG. 5, aiming sight 10 in accordance with an embodiment of the present invention is shown in greater detail. Aiming sight 10 generally includes an LED array 50 and collimator 20 which are housed within a housing 52. Housing 52 includes a front end aperture 56 for operator 46 to look into aiming sight 10. Housing 52 further includes a rear end aperture 58 for operator 46 to look out from aiming sight 10.

LED array 50 is fixed within housing 52 to remain stationary in place. LED array 50 includes a plurality of LEDs generally designated by reference numeral 54. LEDs 54 are spaced apart from one another at different linear positions along the body of LED array 50. As such, LEDs 54 are located at different respective positions with respect to collimator 20.

Collimator 20 is configured to rotate about a pivot axis in order to rotate among different rotation angles (i.e., different rotational positions) with respect to LED array 50. As such, depending upon the rotational position of collimator 20 with respect to LED array 50, one of LEDs 54 will be at a proper location with respect to the rotational position of the collimator to generate a parallax-free aiming dot at a given angular position in an elevation angle adjustment range. That is, for each rotational position of collimator 20, one of LEDs 54 will be at the proper focal point relative to the collimator.

Accordingly, instead of rotating both LED array 50 and collimator 20, aiming sight 10 in accordance with the present invention operates such that only the collimator is rotated with respect to the LED array. Collimator 20 is rotated over an angular range of +/−15° as shown in FIG. 5 to achieve a 30° elevation angle adjustment range of the aiming dot of aiming sight 10. Synchronously with the rotation of collimator 20, a different LED 54 in LED array 50 is turned-on (and the other LEDs 54 are turned-off) such that off-axis angle of the light source for the collimator relative to the rotational position of the collimator is maintained. That is, the LED 54 of LED array 50 which is at a proper focal distance with respect to the rotational position of collimator 20 is turned-on to provide light for the collimator to collimate and the remaining LEDs are turned-off.

Collimator 20 collimates the light from a turned-on LED 54 to generate an aiming dot for operator 46 to see when looking into front end aperture 56. The aiming dot has an angular position within an elevation angle adjustment range. As the turned-on LED 54 and collimator 20 are at a proper location with respect to one another, the aiming dot has parallax-free performance. To change the angular position of the aiming dot while maintaining its parallax-free performance, collimator 20 rotates to a different position with respect to LED array 50 and a different one of LEDs 54 is synchronously turned-on. When this different LED 54 is turned-on all other LEDs 54 including the previously turned-on LED are turned-off. The different LED 54 which is turned-on is the LED that is at the proper focal distance with respect to the new rotational position of collimator 20. As a result, the aiming dot will have a different angular position and parallax-free performance. This process of rotating collimator 20 to a new position while turning on a different LED 54 is repeated to move the parallax-free aiming dot through the 30° elevation angle adjustment range.

To keep the focal distance between respective LEDs 54 and collimator 20 constant for each rotational position of the collimator, LED array 50 may have a curved surface upon which the LEDs are located. Alternatively, LED array 50 is a linear array such as shown in FIG. 5 in which a field flattening lens 60 is placed in front of the LED array in order to maintain the proper focal distance between respective LEDs 54 and collimator 20 for each rotational position of the collimator.

FIG. 5 illustrates three different rotation angles or rotation positions 20*a*, 20*b*, and 20*c* of collimator 20 with respect to LED array 50. FIG. 5 also illustrates the three corresponding LEDs 54*a*, 54*b*, and 54*c* of LED array 50 which are respectively turned-on for the three collimator rotation angles 20*a*, 20*b*, and 20*c*. In operation, LED 54*a* is turned-on (and the other LEDs 54 are turned-off) when collimator 20 has rotation angle 20*a* with respect to LED array 50. In turn, collimator 20 collimates light beams 22*a* emanating from LED 54*a* into collimated light beams 26*a* to generate an aiming dot. The aiming dot will have a first angular position as indicated by reference numeral 62*a*. Likewise, LED 54*b* is turned-on (and the other LEDs 54 are turned-off) when collimator 20 has rotation angle 20*b*. In turn, collimator collimates light beams 22*b* into collimated light beams 26*b* to generate the aiming dot at a second angular position which is indicated by reference numeral 62*b*. Similarly, LED 54*c* is turned-on when collimator 20 has rotation angle 20*c* to generate the aiming dot at a third angular position which is indicated by reference numeral 62*c*.

As such, aiming sight 10 is configured to change angular position of the aiming dot quickly over a relatively large elevation angle adjustment range. Collimator 20 is the only element of aiming sight 10 that rotates in order to change the angular position of the aiming dot over the angle adjustment range. Collimator 20 has a relatively small mass (on the order of 1 ounce). A small motor 64 (shown in FIG. 6) sealed within aiming sight 10 is coupled to collimator 20 to change the rotation angle of the collimator with respect to LED array 50 in order to change the angular position of the aiming dot over the entire 30° elevation angle adjustment range in a parallax-free manner. As a result of the rotation of collimator 20, the placement of LEDs 54 relative to the rotational positions of the collimator, and the selective operation of the LEDs, the collimator is the only element of aiming sight which is actually moved in order to change angular position of the aiming dot. LED array 50 (and its LEDs 54) and other aiming sight elements such as a power supply 68 (shown in FIG. 6) and control electronics 66 (i.e., controller 66 shown in FIG. 6) remain fixed in position.

An elevation angle adjustment range of 30° of an aiming dot having a size of 4.0 minute of angle (m.o.a.) can be achieved by using an LED array 50 with forty-two LEDs 54 spaced 1.00 mm apart, an LED size of 0.10 mm, and collimator 20 with an 80 mm focal length. A larger elevation angle adjustment range can be obtained by using a proportionally larger LED array. Typically, the power of LEDs in an LED array is limited by heat dissipation considerations. However, in aiming sight 10 only one LED 54 (or perhaps a small subset of neighboring LEDs) of LED array 54 is turned-on at any one time in accordance with the present invention. Higher powered LEDs can therefore be used in LED array 50. Alternatively, LEDs which emit light having a wavelength of 630 nm can be used in LED array 50. The higher photopic response of the eyes of a human observer will increase the perceived brightness by two-to-three times over deep red LEDs which are typically used in LED arrays that emit in the 650 nm to 670 nm region.

The resolution of the elevation angle adjustment of the aiming dot of aiming sight 10 is determined by the rotation resolution of collimator 20 as opposed to the spacing between LEDs 54. Each LED 54 covers an angular range of +/−20 m.o.a. which is within the off-axis performance of collimator 20. Parallax-free performance can therefore be maintained throughout the 30° elevation angle adjustment range. With a motor 64 (shown in FIG. 6) having a ten-bit encoder and 12:1 gearing, an angular resolution of 30°/1024=0.03° (1.75 m.o.a.) can be achieved for the aiming dot over the entire 30° elevation angle adjustment range.

Figure 6:
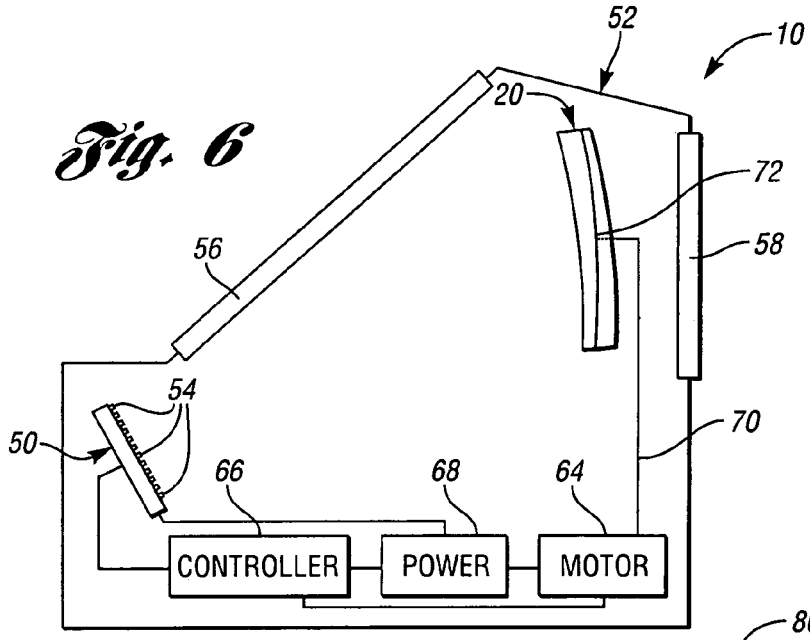
FIG. 6 illustrates a cross-sectional view of the aiming sight using block diagrams.

Referring now to FIG. 6, a block diagram of aiming sight 10 is shown in order to illustrate motor 64, control electronics 66, and power supply 68. Like LED array 50, motor 64, control electronics 66, and power supply 68 are fixed stationary in place. LED array 50, motor 64, and control electronics 66 are connected to power supply 68 in order to receive electrical power. Motor 64 (i.e., a rotator) includes a drive shaft 70 which is connected at pivot axis 72 of collimator 20. When driven, drive shaft 70 rotates to rotate collimator 20 about its rotational positions. Motor 64 includes a rotary encoder to keep track of the rotation of drive shaft 70 and to thereby keep track of the rotational position of collimator 20. Control electronics 66 controls the operation of motor 64 and is connected with LED array 50 to control which LEDs 54 are turned-on. As described above, control electronics 66 controls which one of LEDs 54 is turned-on at any one time as a function of the rotational position of collimator 20.

Figure 7:
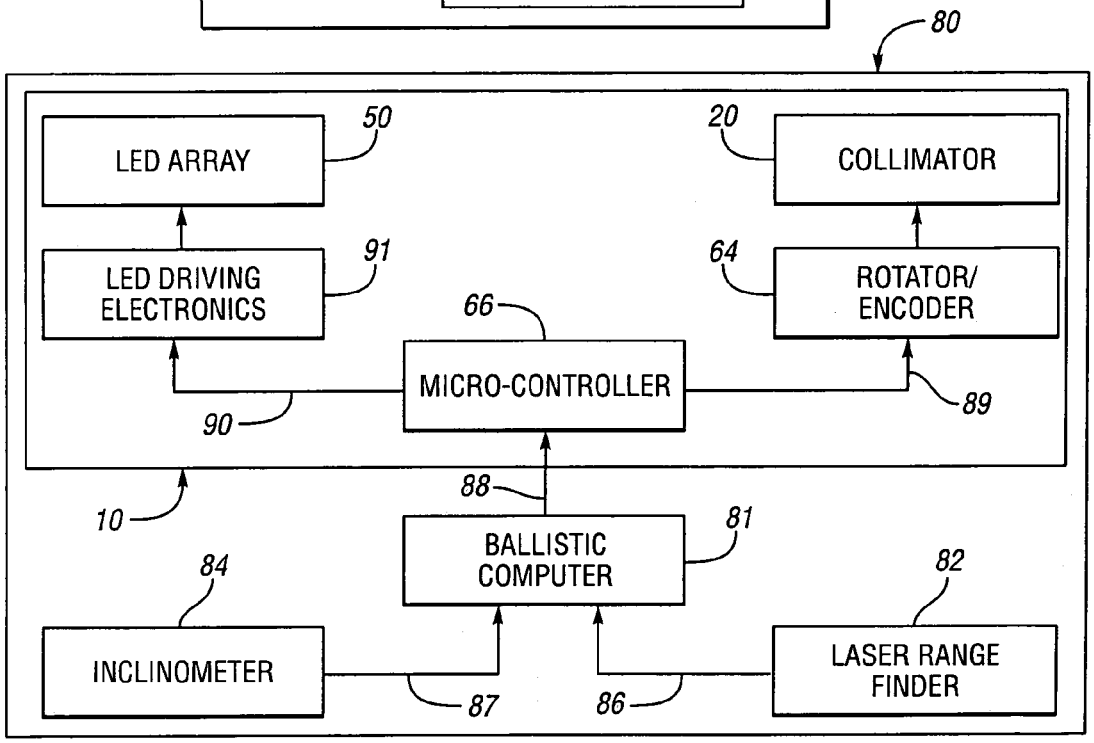
FIG. 7 illustrates a block diagram of a fire control system for use with a firearm in accordance with the present invention.

Referring now to FIG. 7, a fire control system 80 for use with a firearm in accordance with the present invention is shown. Fire control system 80 generally includes aiming sight 10, a ballistic computer 81, a laser range finder 82, and an inclinometer (or tilt sensor) 84. Laser range finder 82 determines a target range to a target and then generates a signal 86 indicative of the target range. Inclinometer 84 determines a depression (or elevation) angle of the target relative to the location of aiming sight 10 and then generates a signal 87 indicative of the target depression angle. Ballistic computer 81 uses target range signal 86 and target depression angle signal 87 to compute the amount of ballistic compensation required. That is, ballistic computer 81 uses target range signal 86 and target depression angle signal 87 to determine the elevation angle for the firearm to engage the target. Ballistic computer 81 then generates a signal 88 indicative of the elevation angle.

Micro-controller (i.e., controller) 66 of aiming sight 10 generally uses elevation angle signal 88 to control the rotation angle of collimator 20 and to control which LED 54 of LED array 50 is turned-on to provide light to the collimator. That is, micro-controller 66 controls the rotation angle of collimator 20 and selectively turns-on the LED of LED array 50 which is at the proper focal distance relative to the rotation angle of the collimator in order for the turned-on LED and the collimator to generate an aiming dot having an angular position corresponding to the elevation angle.

Particularly, upon receiving elevation angle signal 88, micro-controller 66 determines a collimator rotation angle corresponding to the elevation angle. Micro-controller 66 then generates a signal 89 indicative of the rotation angle. Rotator (i.e., motor 64) receives rotation angle signal 89 and then moves collimator 20 to the rotation angle. Rotator 64 includes a rotary encoder which monitors the position of collimator 20 as the collimator rotates to the rotation angle. Rotator 64 ceases moving collimator 20 upon the rotary encoder determining that the collimator has been moved to the rotation angle.

Synchronously, upon receiving elevation angle signal 88, micro-controller 66 determines which LED of LED array 54 corresponds to the elevation angle. That is, micro-controller 66 determines which LED of LED array 54 is at the proper focal distance relative to the rotation angle of collimator 20. Micro-controller 66 then generates a signal 90 indicative of the proper LED. LED driving electronics 91 associated with LED array 50 receives proper LED signal 90 and then turns-on the determined LED of LED array 50. The turned-on LED provides light to collimator 20 for the collimator to use to generate an aiming dot. The aiming dot has an angular position corresponding to the elevation angle as a result of: i) collimator 20 having the rotation angle corresponding to the elevation angle; and ii) the turned-on LED is at the proper focal distance relative to the rotation angle of the collimator.

In operation, laser range finder 82 is aligned with aiming sight 10 at a reference position (e.g., the aim point at 150 meters). To range to the target, an operator presses a button to set up. In response, the aim point is moved to the reference position in a fraction of a second. Operator 46 then puts the aim point on the target or any object having the same range as the target and then presses the button again. Ballistic computer 81 then reads target range data 86 and target depression angle data 87 to compute the elevation angle. In turn, micro-controller 66 rotates collimator 20 and turns-on the corresponding LED 54 as a function of the elevation angle. This can be accomplished on the order of one second. From then on, all operator 46 has to do is point and shoot the firearm upon which aiming sight 10 is mounted.

Figure 8:
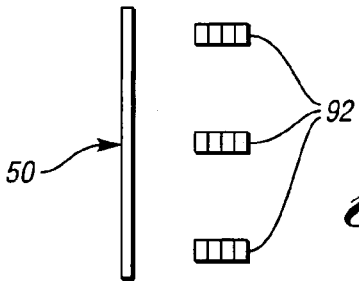
FIG. 8 illustrates a block diagram of alpha-numeric displays used with the LED array of the aiming sight to display target range data for an operator.
Figure 9:
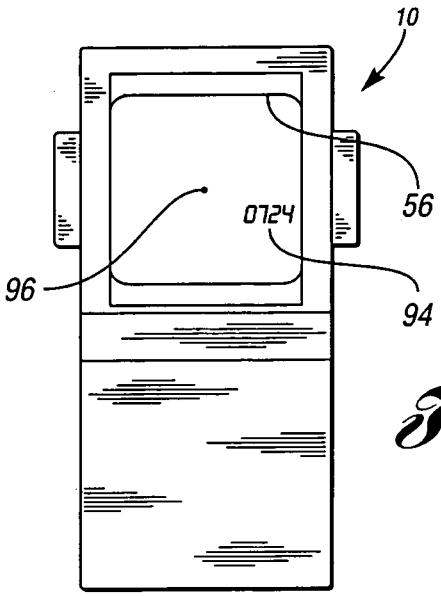
FIG. 9 illustrates a numeric range data displayed through a front end aperture of the aiming sight for an operator to see along with an aiming dot of the aiming sight.

Referring now to FIG. 8, a block diagram of alpha-numeric displays 92 which are used with LED array 50 of aiming sight 10 to display target range data for operator 46 is shown. In operation, the alpha-numeric display 92 which is closest to LED 54 that is turned-on at any one time for a particular range angle is used to display the range data. The range data is displayed as a numeric display 94 on front end aperture 56 for operator 46 to see along with an aiming dot 96 as shown in FIG. 9.

Figure 10:
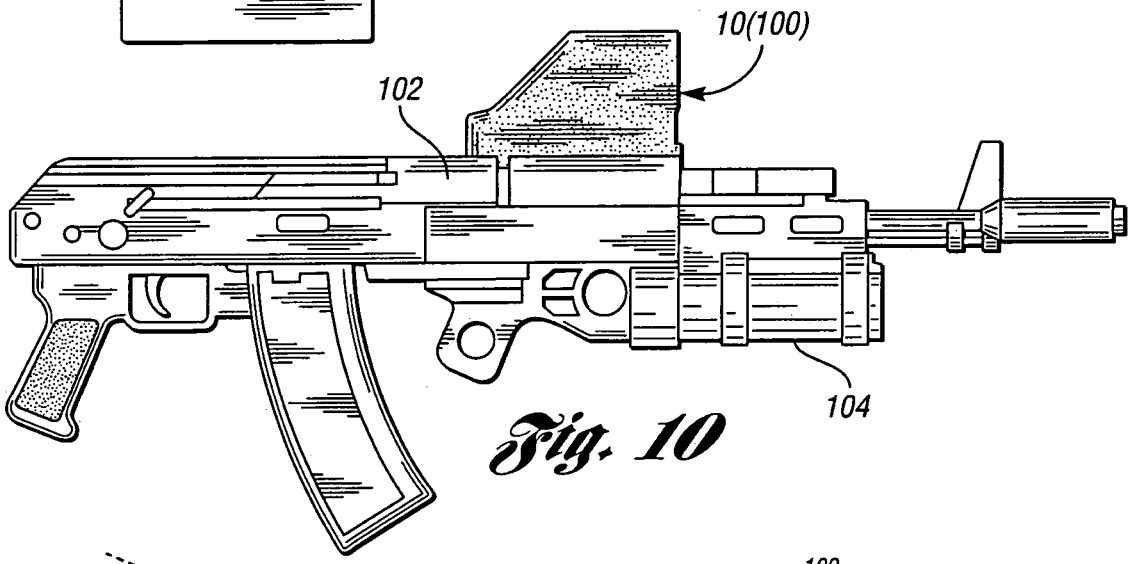
FIG. 10 illustrates a plan perspective view of an aiming sight in accordance with the present invention mounted on a rifle having a grenade launcher.

Aiming sight 10 has been described thus far as for use with a low-velocity firearm such as grenade launcher 12. Grenade launchers, which are relatively low-velocity projectile firearms, are often attached to relatively high-velocity firearms such as rifles. Such a configuration is shown in FIG. 10 in which aiming sight 10 is mounted on top of a rifle 102 and a grenade launcher 104 is mounted underneath the rifle. In this configuration, aiming sight 10 lends itself to use as an aiming sight for both rifle 102 and grenade launcher 104. Alternatively, aiming sight 10 can be combined with a holographic sight to provide aiming for both rifle 102 and grenade launcher 104 at the same time.

Adding an Aiming Point for a Rifle

In order to add an aiming point for rifle 102, a single high-brightness LED is placed below LED array 50 of aiming sight 10. This single LED provides the aiming dot (i.e., 5.56 ammo) for rifle 102. (As described above, LEDs 54 of LED array 50 in conjunction with collimator 20 provides the aiming dot for grenade launcher 104). The single rifle LED is fixed in position and its projected image is aligned with that of a laser range finder. Zeroing of aiming sight 10 is accomplished by rotating the entire aiming sight in order to maintain alignment between the aiming dot for the rifle and the laser range finder. LED array 50 can be translated sideways to adjust the aim in the azimuth direction. The adjustment in elevation is handled by control electronics 66.

With this approach, aiming sight 10 can be used to either aim rifle 102 or grenade launcher 104 at any one time. Collimator 20 is rotated to switch between the two modes. A time lag on the order of 0.5 seconds for collimator 20 to rotate is required and the operator has to initiate the change. There is no need for the operator to see both aiming dots at the same time and it would take at least 0.5 seconds to change the elevation of the weapon to switch it from using it as rifle 102 or grenade launcher 104. However, the operator has to initiate the switch between the operating modes by pressing a button or the like. If the operator forgets to press such a button to initiate the operating mode change before changing the elevation angle of the weapon to go from the grenade launcher mode to the rifle mode, the operator will not see the aiming dot.

Such a configuration is relatively simple and cost efficient to implement. However, the need for the operator to initiate the change between the rifle and grenade launcher modes is a disadvantage. An alternative approach is to integrate aiming sight 10 with a holographic sight into an integrated grenade launcher and rifle aiming sight.

Combining the Aiming Sight with a Holographic Sight

Figure 11:
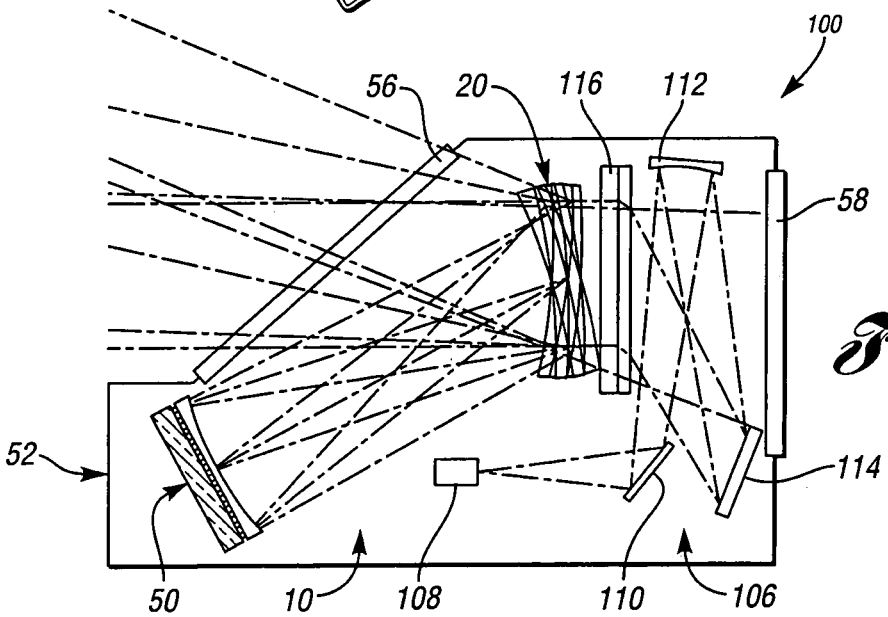
FIG. 11 illustrates a cross-sectional view of an integrated grenade launcher and rifle aiming sight in accordance with the present invention.

Referring now to FIG. 11, with continual reference to FIG. 10, an integrated grenade launcher and rifle aiming sight 100 in accordance with the present invention is shown. Integrated grenade launcher and rifle aiming sight 100 essentially includes aiming sight 10 combined with a holographic sight 106.

Holographic sight 106 is described in U.S. Pat. No. 6,490,060 hereby incorporated by reference in its entirety. Holographic sight 106 generally includes a laser diode 108, a folding mirror 110, a reflective collimator 112, a holographic grating 114, and a hologram 116. These elements are securely mounted within housing 52. The optical path of holographic sight 106 is folded and the light propagation is primarily in the vertical direction. The diverging laser beam from laser diode 108 is reflected generally upward by folding mirror 110 towards off-axis collimator 112. The laser beam becomes collimated after it is reflected off of collimator 112 and directed generally downward towards reflective diffraction grating 114. Grating 114 diffracts the laser light generally upward to hologram 116 which has been recorded with the projected image of a reticle pattern.

Holographic sight 106 operates in the transmission mode. The laser beam from laser diode 108 illuminates hologram 166 from the front (i.e., the target side). As such, the operation of holographic sight 106 is opposite to that of a reflex or red-dot aiming sight such as aiming sight 10. This allows aiming sight 10 and holographic sight 106 to be combined into integrated grenade launcher and rifle aiming sight 100. Because of the large (30°) field angle of the grenade launcher sight (i.e., aiming sight 10), front end aperture 56 of housing 52 has to be larger than collimator 20. This is not a problem with the design of holographic sight 106 as shown in FIG. 11.

As indicated above, the optics of holographic sight 106 is fixed within housing 52 and its reticle is factory aligned with a laser range finder. Zeroing is done by rotating the entire housing 52 in order to maintain co-alignment of the laser range finder and the reticle of hologram 116. An operator places the reticle of hologram 116 on a target to be ranged and then presses a button. The target distance is measured and passed onto control electronics 66 together with inclinometer data to determine the appropriate elevation angle. Collimator 20 of aiming sight 10 is then rotated to the corresponding rotational angle, the matching LED 54 of LED array 50 of aiming sight 10 is turned-on, and the range data is shown by the alpha-numeric display.

The reticle of holographic sight 106 for rifle 102 and the aiming dot of aiming sight 10 for grenade launcher 104 are both available at the same time and can be independently zeroed. Holographic rifle sight 106 and a transmitter and a receiver of a laser range finder are co-aligned at a factory. Zeroing is done by rotating the entire integrated grenade launcher and rifle aiming sight 100. LED array 50 of grenade launcher aiming sight 10 can be translated transversely to adjust the azimuth alignment. The amount of adjustment required is quite small having to accommodate only for the mounting inconsistence of grenade launcher 104 on rifle 102. Because the elevation is controlled electronically by the rotation angle of collimator 20 and the position of the selected LED 54 of LED array 50, the elevation adjustment can be accomplished electronically. By pressing an UP or DOWN button, it instructs control electronics 66 to adjust the programming to shift the elevation angle higher or lower.

Thus, it is apparent that there has been provided, in accordance with the present invention, an aiming sight having a fixed LED array and a rotatable collimator that fully satisfies the objects, aims, and advantages set forth above. While embodiments of the present invention have been illustrated and described, it is not intended that these embodiments illustrate and describe all possible forms of the present invention. Rather, the words used in the specification are words of description rather than limitation, and it is understood that various changes may be made without departing from the spirit and scope of the present invention.

What is claimed is:

1. An aiming sight comprising:

an LED array having a plurality of LEDs, the LED array being fixed to be stationary in a position;

a collimator which is rotatable to rotate to different angular positions with respect to the LED array;

wherein an LED turns-on as a function of the angular position of the collimator while the remaining LEDs are turned-off such that the collimator collimates light from the turned-on LED into an aiming dot having a given angular position.

2. The aiming sight of claim 1 wherein:

the LEDs are positioned along the LED array such that one LED and the collimator are at a constant angle and separated by a constant focal distance for each angular position of the collimator.

3. The aiming sight of claim 2 wherein:

the LED which is at the constant angle and separated from the collimator by the constant focal distance for a corresponding angular position of the collimator turns-on while the remaining LEDs are turned-off when the collimator rotates to the corresponding angular position in order to adjust the angular position of the aiming dot.

4. The aiming sight of claim 2 wherein:

for each angular position of the collimator, the LED which is at the constant angle and separated from the collimator by the constant focal distance turns-on while the remaining LEDs are turned-off such that the collimator collimates light from the turned-on LED into the aiming dot at a different angular position for each angular position of the collimator.

5. The aiming sight of claim 4 wherein:

the collimator and corresponding LEDs are separated by the constant focal distance for each angular position of the collimator to cause the aiming dot at each angular position of the collimator to be parallax-free.

6. The aiming sight of claim 2 wherein:

the LED which is at the constant angle and separated by the constant focal distance from the collimator when the collimator rotates to another angular position turns-on while the remaining LEDs turn-off such that the collimator collimates light from the turned-on LED into an aiming dot having a different angular position which corresponds to the angular position of the collimator.

7. The aiming sight of claim 2 wherein:

the LED array is a linear LED array upon which the LEDs are positioned at respective linear positions along the linear LED array, the linear LED array having a field flattening lens such that the collimator and a corresponding LED are effectively at the constant angle and separated by the constant focal distance for each angular position of the collimator.

8. The aiming sight of claim 1 wherein:

the collimator includes first and second glass elements, the first and second glass elements each having front and rear spherical surfaces, the front surface of the first glass element and the rear surface of the second glass element having a first radius, the rear surface of the first glass element and the front surface of the second glass element having a different second radius, wherein the rear surface of the first glass element and the front surface of the second glass element are joined together along a middle surface to form the collimator, the middle surface having a reflection coating for collimating light from the LEDs.

9. The aiming sight of claim 4 further comprising:

a plurality of alpha-numeric displays, each alpha-numeric display placed beside a corresponding LED of the LED array and each alpha-numeric display associated with a measured target range, wherein the alpha-numeric display which corresponds to the turned-on LED displays the measured target range.

10. An aiming sight comprising:

a controller;

a power supply;

an LED array having a plurality of LEDs, the LED array being powered by the power supply to turn-on and turn-off the LEDs; and a collimator which is powered by the power supply to rotate, wherein the collimator rotates to different rotational positions with respect to the LED array while the controller, the power supply, and the LED array remain fixed in place;

wherein the LEDs are positioned along the LED array such that one LED and the collimator are at a constant angle and separated by a constant focal distance for each rotational position of the collimator;

wherein the controller controls the collimator to rotate to a rotational position in order to generate an aiming dot having an angular position corresponding to the rotational position of the collimator;

wherein the controller controls the LED array to turn-on the LED which is at the constant angle and separated from the collimator by the constant focal distance and to turn-off the remaining LEDs such that the collimator collimates light from the turned-on LED into the aiming dot at the angular position corresponding to the rotational position of the collimator.

11. The aiming sight of claim 10 wherein:

the controller controls the collimator to rotate to a second rotational position with respect to the LED array in order to adjust the angular position of the aiming dot;

wherein the controller controls the LED array to turn-on the LED which is at the constant angle and separated from the collimator by the constant focal distance at the second rotational position of the collimator and controls the remaining LEDs to be turned-off such that the collimator collimates light from the turned-on LED into the aiming dot having a different angular position which corresponds to the second rotational position of the collimator.

12. The aiming sight of claim 11 wherein:

the controller controls the collimator to rotate to a third rotational position with respect to the LED array in order to further adjust the angular position of the aiming dot;

wherein the controller controls the LED array to turn-on the LED which is at the constant angle and separated from the collimator by the constant focal distance at the third rotational position of the collimator and controls the remaining LEDs to be turned-off such that the collimator collimates light from the turned-on LED into the aiming dot having a different angular position which corresponds to the third rotational position of the collimator.

13. The aiming sight of claim 12 wherein:

the collimator and corresponding LEDs are separated by the constant focal distance for each rotational position of the collimator to cause the aiming dot at each rotational position of the collimator to be parallax-free.

14. An integrated aiming sight assembly comprising:

a first aiming sight contained within a housing, the first aiming sight having:

an LED array being fixed in position;

a collimator which is movable to different angular positions with respect to the LED array;

wherein an LED of the LED array turns-on as a function of the angular position of the collimator while the remaining LEDs of the LED array are turned-off such that the collimator collimates light from the turned-on LED into an aiming dot having a given angular position for an operator to see when looking through the housing; and a holographic aiming sight contained within the housing, the holographic aiming sight providing a reticle for the operator to see when looking through the housing.

15. The integrated aiming sight assembly of claim 14 wherein:

the aiming dot of the first aiming sight and the reticle of the holographic sight are provided for the operator to see at the same time.

16. The integrated aiming sight assembly of claim 15 wherein in the first aiming sight:

the LEDs of the LED array are positioned along the LED array such that one LED and the collimator are at a constant angle and separated by a constant focal distance for each angular position of the collimator;

for each angular position of the collimator, the LED which is at the constant angle and separated from the collimator by the constant focal distance turns-on while the remaining LEDs are turned-off such that the collimator collimates light from the turned-on LED into the aiming dot at a given angular position for each angular position of the collimator.

* * * * *